United States Patent [19]

McElhenny

[11] 4,302,811

[45] Nov. 24, 1981

[54] AUTOMATIC TRAIN OPERATION WITH POSITION STOP AND VELOCITY CONTROL

[75] Inventor: Stuart W. McElhenny, Erie, Pa.

[73] Assignee: General Electric Company, Erie, Pa.

[21] Appl. No.: 74,365

[22] Filed: Sep. 10, 1979

[51] Int. Cl.[3] ..... G06F 15/50

[52] U.S. Cl. ..... 364/426; 246/182 B; 246/187 B

[58] Field of Search ..... 364/426, 436; 246/182 B, 182 C, 187 B

[56] References Cited

U.S. PATENT DOCUMENTS

| | | | |
|---|---|---|---|
| 3,334,224 | 8/1967 | Allen et al. | 246/187 B |
| 3,450,875 | 6/1969 | Whitten et al. | 246/34 |
| 3,457,487 | 7/1969 | Cooper | 318/332 |
| 3,519,805 | 7/1970 | Thorne-Booth | 364/426 |
| 3,524,055 | 8/1970 | Smith | 246/182 B |
| 3,639,754 | 2/1972 | Kovalcik et al. | 246/182 B |
| 3,891,833 | 6/1975 | Rhoton et al. | 364/426 |
| 3,934,125 | 1/1976 | Macano | 246/182 B |
| 4,123,023 | 10/1978 | Nelson | 246/182 B |

*Primary Examiner*—Jerry Smith

*Attorney, Agent, or Firm*—Albert S. Richardson, Jr.

[57] ABSTRACT

An improved automatic control system for a train of transit vehicles which regulates the velocity of the train and its braking rate in accordance with a predetermined velocity/distance profile. The system includes apparatus for compensating for variations in wheel diameter and train length in such a manner as to assure that the center of the train regularly stops at a predetermined point with respect to a desired station stopping point. On board receivers are responsive to wayside signal devices for establishing the operating velocity of the vehicle and for initiating entry into the predetermined braking profile. Since vehicle control is effected by wayside signal devices, the distance between stopping points may be indefinite. The system includes apparatus which permits passing selected stopping points when desired.

8 Claims, 13 Drawing Figures

| FIG.3A | FIG.3B | FIG.3C |
|---|---|---|

| FIG.6A | FIG.6B | FIG.6C |
|---|---|---|

AUTOMATIC TRAIN OPERATION WITH POSITION STOP AND VELOCITY CONTROL

BACKGROUND OF THE INVENTION

This invention relates to automatic control systems for traction vehicles and has particular application to rapid transit or other railway vehicles.

Automatic train operation (ATO) control systems have been developed to improve the operation of rapid transit systems and to minimize the opportunity for accidents caused by human error. In general, ATO systems include signal devices positioned along a fixed guideway, such as a railway track or monorail system, for providing information to vehicles on the guideway as to the position of the vehicles and the velocity at which the vehicles are to proceed. Communication receivers on the vehicles receive the information from the wayside signal devices and convey it to the ATO control circuitry which controls power and braking to regulate the velocity of the vehicles.

An exemplary ATO system is shown in U.S. Pat. No. 3,334,224 issued on Aug. 1, 1967 to R. K. Allen and I. W. Lichtenfels and assigned to the General Electric Company. That patent discloses an analog ATO system, i.e., an ATO system in which values are determined by the magnitude of continuously variable voltage and current signals.

Although ATO systems for controlling the velocity of a vehicle are not unusually complex, the addition of control circuitry to stop the vehicle at a predetermined position without excessive deceleration or jerk can result in a quite complex arrangement. Furthermore, the implementation of position stop circuitry using analog techniques—which require multiple potentiometers for setting voltage levels and rely on capacitor energy storage—may become, in addition to being complex, excessive in physical size. For example, many additional components may be needed if the position stop circuit is required to adjust the stopping point of the lead vehicle in a train of vehicles which can vary from one to ten vehicles in length. In addition, the diameter of the steel wheels on the vehicles change with service and the system must compensate for that change in computing the position of the train with respect to the stopping point.

OBJECT OF THE INVENTION

It is an object of this invention to provide an improved ATO control system for a vehicle traveling on a fixed guideway.

It is another object of this invention to provide an improved ATO control system with a position stop control which can be easily adjusted to accommodate variable train lengths and wheel diameters.

DESCRIPTION OF THE DRAWINGS

For a better understanding of the present invention, reference may be had to the forthcoming detailed description taken in conjunction with the accompanying drawings in which.

DESCRIPTION OF THE INVENTION

Figure 1:
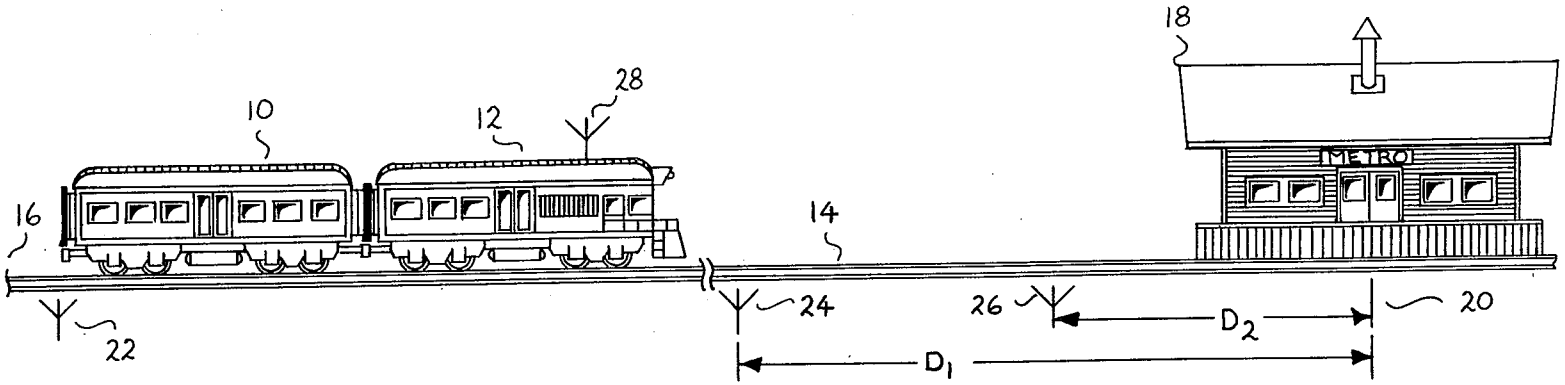
FIG. 1 is a representative diagram of a pair of vehicles on a fixed guideway which are controlled in accordance with the present invention to decelerate smoothly to a full stop at a desired stopping point.

Referring to FIG. 1, there is illustrated a train of two vehicles 10 and 12 which are adapted to move along a rail or fixed guideway 14 from a starting point 16 to a station or terminal 18 at which is located a desired stopping point 20. Positioned along the guideway 14 are a plurality of wayside signal devices indicated schematically at 22, 24, and 26, which devices may be of a passive or active type, both types being well known in the art. Preferably the lead vehicle 12 in the train is designated as the controlling vehicle and is accordingly shown as including a receiver, indicated schematically at 28, for receiving information from the wayside signal devices 22, 24 and 26. In practice, the device 22 may provide information specifying a desired velocity for the vehicles 10 and 12 whereas the devices 24 and 26 may provide information specifying the distances $D_1$ and $D_2$, respectively, to the desired stopping point 20. Over a relatively long section of track, the device 22 may be repeated any number of times and may command the same or different velocities. Similarly, the ATO system on board the vehicle 12 may be capable of responding to the device 24 for stopping the train at the desired stopping point 20, but additional signal devices such as device 26 may be added to the wayside system in order to provide additional assurance of the accuracy of the ATO system by periodic updates.

Although not shown in detail, the vehicles 10 and 12 are preferably of the type powdered by electric traction motors connected to selected wheels of each vehicle.

Figure 2:
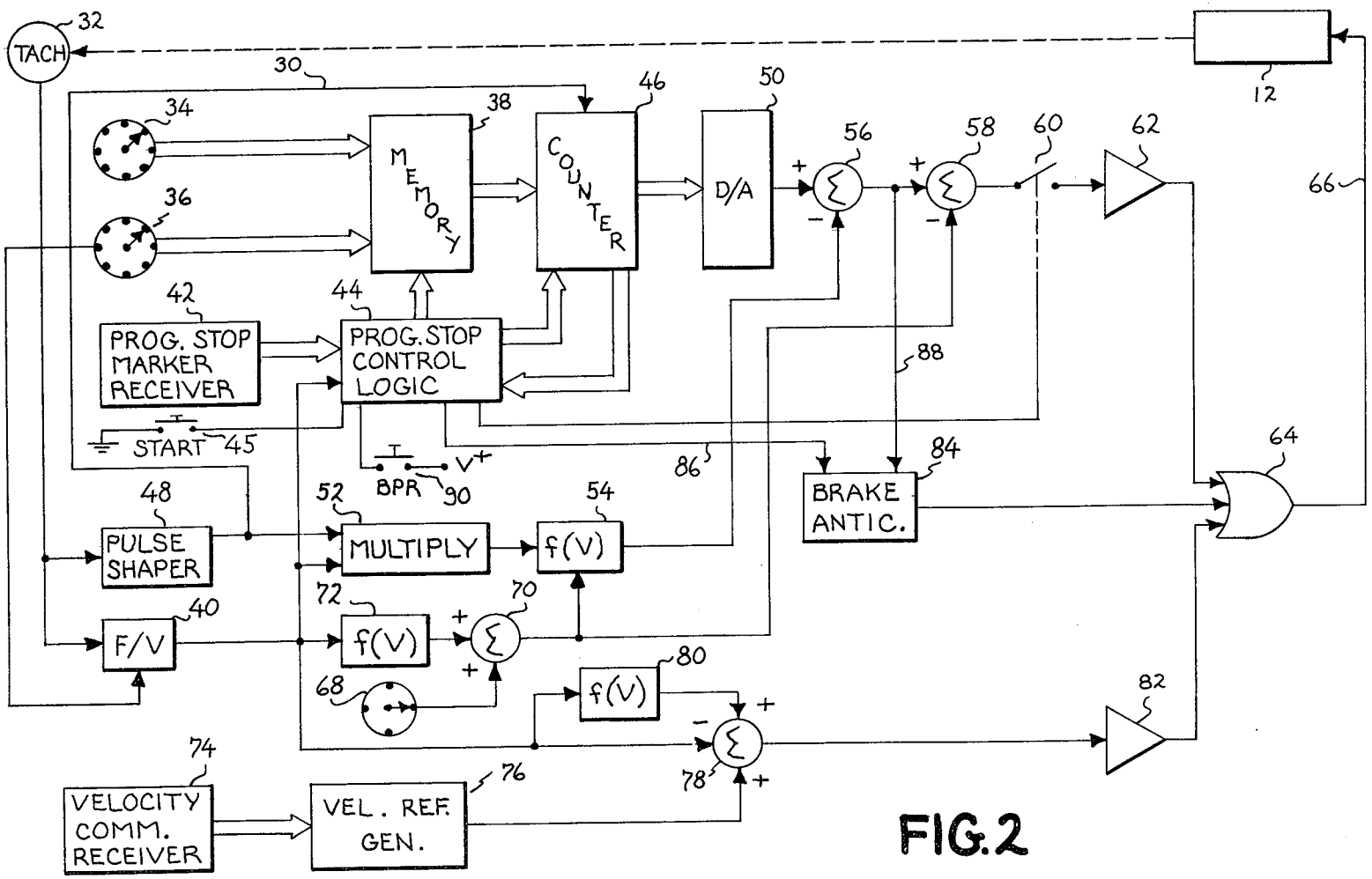
FIG. 2 is a block diagram of a program stop control system according to the present invention.

Referring now to FIG. 2, there is illustrated a preferred embodiment of an ATO control system according to the present invention for providing a tractive effort control signal which will control the power supplied to the electric traction motors of a vehicle indicated at 12. The system includes a speed sensor 32 associated with a wheel (not shown) of the vehicle 12 for developing an output signal representative of the angular velocity of the wheel. The speed sensor 32 may comprise any of the well known types of velocity sensing devices and is preferably a tachometer generator mounted to produce a plurality of discrete pulses for each revolution of the monitored wheel, such as by being mounted adjacent a driven gear so that a pulse is produced each time a gear tooth passes by the sensor 32.

Included also is a switch 34 which may be manually set to indicate the number of vehicles in the train. Another switch 36, which may also be manually set, is included to indicate the diameter of the wheel being monitored by sensor 32 since the wheel diameter affects the number of revolutions the wheel will turn in moving through a fixed linear distance. Both switches 34 and 36 are arranged to provide an output signal indicative of their respective set positions.

The output signals developed by switches 34 and 36 are coupled to a memory storage device 38 which uses the switch position signals as part of an address location, i.e., an address of a location in the memory at which the desired information is stored. The signal from switch 36 is also coupled to a frequency to voltage converter 40 which is further connected to receive the signals from the speed sensor 32.

Frequency to voltage converter 40 may be of a type well known in the art for converting a string of pulses at varying frequencies to a d-c voltage level representative of the pulse frequency. The voltage magnitude from converter 40 is representative of the linear velocity of the vehicle 12. Accordingly, the converter 40 is responsive to the signal from switch 36 for adjusting the magnitude of its velocity representative output voltage as a function of the diameter of the wheel being monitored by sensor 32. Such an adjustment is necessary since the number of pulses per wheel revolution produced by sensor 32 remains constant even though the wheel diameter may vary resulting in a varying number of pulses per unit of linear distance traveled by the vehicle 12. For adjustment purposes the converter 40 may include an output amplifier whose gain is adjusted by the signal from switch 36 such that the analog velocity signal from converter 40 is maintained proportional to linear velocity of the vehicle 12.

The program stop function is implemented when the vehicle 12 passes a wayside signal device and an appropriate signal is detected by a vehicle carried program stop marker receiver 42. The details of such a receiver 42 are well known in the art and may take the form of the carrier receivers shown and described in the aforementioned U.S. Pat. No. 3,334,224. As disclosed in that patent, the receiver 42 is preferably a tone modulated receiver which identifies the location of the received signal by its frequency modulation. Since each wayside signal device is located at a different predetermined fixed distance from a desired stopping point, the information conveyed by each device is an identity code rather than distance data.

The program stop marker receiver 42 provides an output signal representing the identity of the received wayside signal to a program stop control logic circuit 44. The logic circuit 44 provides several functions, a primary function being to convert the signal from receiver 42 to a digital address for use in addressing the memory device 38. The combination of the digital signals from logic circuit 44, switch 34 and switch 36 provides a complete digital address specifying a location in memory device 38 at which is stored a digital number representative of the number of revolutions through which a wheel of the diameter specified by switch 36 will revolve in order to stop the center of the train of vehicles at the desired stopping point. When the memory device 38 is addressed, it transfers to its output terminals the value stored at the addressed location. The functions performed by logic circuit 44 are initiated by closing a START switch 45.

A counter 46 of a type well known in the art has its input terminals connected to the output terminals of memory device 38. Each time that a wayside signal device is detected by the vehicle 12 and a new address generated by logic circuit 44, the circuit 44 also provides an enable signal to counter 46 so that the digital number developed at the output terminals of memory device 38 is transferred into an internal register of counter 46. The value in the internal register is thereafter counted down as a function of the revolutions of the wheel whose velocity is being monitored. As shown, the counting down function is accomplished by connecting the pulses developed by speed sensor 32 to a clock terminal of counter 46 via a conductor 30. Thus, the sensor 32 produces pulses representative of wheel rotation which pulses are effective to decrement the number stored in counter 46. Preferably the pulses developed by sensor 32 are shaped by a pulse shaper circuit 48 before being supplied to counter 46. Such shaping circuits are well known in the art and may also include level detection to minimize spurious pulses caused by a noisy environment.

Since the number stored in the counter 46 is decremented as a function of the revolutions of the vehicle wheel, i.e., the distance actually traveled by the vehicle, the number remaining in the counter 46 at any time is a reference signal representative of the distance remaining to the desired stopping point. In a preferred embodiment the power control system for the vehicle 12 requires analog command or error signals for operation. Accordingly, the digital reference signal from counter 46 is converted to an analog signal by a digital-to-analog (D/A) converter 50 of a type well known in the art. The magnitude of the signal developed by D/A converter 50 then becomes a distance-to-go reference signal 'd.'

In the program stop mode of operation the control system is arranged to control the vehicle deceleration rate such that a predetermined velocity versus distance profile is maintained. The criteria for the profile is to provide smooth, jerk free deceleration with complete cessation of movement at the desired stopping point. The program stop control system therefore supplies to the vehicle power control system a control error signal or command signal which calls for a desired braking rate of deceleration rate. The desired deceleration rate may be set at any selected value, e.g., one mile per hour per second or five miles per hour per second or any other desired value, and that rate could then be commanded by an appropriate magnitude of the control error signal. However, stopping the vehicle at the desired point requires dynamic adjustment of the control error signal as a function of the position of the vehicle on the guideway. The system thus far described provides a critical component of the dynamic adjustment arrangement, i.e., the reference distance-to-go signal 'd' is a continuous reference of the actual position of the vehicle on the guideway with respect to the desired stopping point. Another critical component in the dynamic adjustment arrangement is the determination of whether the velocity of the vehicle at any actual position meets the predetermined velocity/distance profile. To this end, another portion of the program stop circuit continuously determines the distance required to stop the vehicle given its current velocity and the desired deceleration rate.

In order to determine distance as a function of velocity, the velocity representative pulses developed at an output terminal of pulse shaper 48 are applied to a first input terminal of a multiplier circuit 52. A second input terminal of multiplier circuit 52 is connected to an output terminal of frequency-to-voltage converter 40 for receiving a signal whose magnitude is representative of vehicle velocity. Multiplier circuit 52 operates to multiply the signals on its first and second input terminal to thereby develop at an output terminal a signal representative of the product of the two input signals. Since both input signals are representative of the velocity of the vehicle 12, the product signal developed by circuit 52 is representative of the square of vehicle velocity.

The velocity square signal ($V^2$) from circuit 52 is coupled to a first input terminal of a circuit 54 which is connected as a divider circuit. A second input terminal of circuit 54 is connected to receive a signal representative of the desired deceleration rate (a). The circuit 54 operates to divide the velocity square signal ($V^2$) by twice the value of the deceleration rate signal (a) so as to develop at an output terminal a signal representative of the quotient $V^2/2a$, hereinafter referred to as 's,' which is readily apparent to be the distance required to stop from the present velocity "V" given a constant deceleration rate "a".

The distance-to-go reference signal 'd' is algebraically summed with the distance-to-go feedback signal 's' in a summing junction 56. The summing junction 56 may be either a resistor network or an active amplifier capable of summing two input signals and providing an output signal whose amplitude and polarity are respective of any difference between the input signals. In this instance, the output signal developed by junction 56 represents the distance-to-go error, i.e., the deviation between the computed distance-to-go 'd' and the distance 's' required to stop at the desired deceleration rate. Depending upon the control system in use, a negative error may call for additional braking and a positive error for less braking.

The distance-to-go error signal is combined with the signal 'a' representative of the desired deceleration rate to produce a brake control error signal 'E.' To accomplish this function, the distance-to-go error signal is coupled to a first input terminal of a summing junction 58 where it is combined with the desired deceleration rate signal 'a', the latter signal being coupled to a second input terminal of junction 58. The brake control error signal 'E' is thereafter developed at an output terminal of junction 58.

From junction 58 the brake control error signal is coupled through a switch 60, an amplifier circuit 62 and an analog "OR" circuit 64 to an output conductor 66 and thence to the power control system for the motors propelling the vehicle 12. The signal on conductor 66 whether provided by the brake rate circuitry just described or by the velocity control circuit to be described hereinafter is a tractive effort control signal for the power controlling system of the vehicle 12. A detailed description of the use of the signal on conductor 66 for controlling the vehicle 12 may be had by reference to U.S. Pat. No. 3,457,487 issued on July 22, 1969 to D. Cooper and assigned to the General Electric Company. In that patent the block labeled "TRACTIVE EFFORT SIGNAL SOURCE" corresponds to the system diagram herein identified as FIG. 2.

Referring still to FIG. 2, the desired deceleration rate 'a' may be selected by a rate selection circuit indicated schematically as a switch 68 on board the vehicle 12. The specifying of a desired rate could also be implemented with a wayside signal device and on-board receiver. The switch 68 is preferably arranged such that a different predetermined voltage magnitude is produced for each different desired braking or deceleration rate.

For most of the operating velocities of the vehicle the signal developed by switch 68 is used as the desired deceleration rate signal. However, at very slow or relatively fast speeds, the signal from switch 68 is modified slightly to avoid "jerks" or step-changes in velocity. This signal modification is accomplished by coupling the signal from switch 68 to a first input terminal of a summing junction 70. A second input terminal of junction 70 is connected to an output terminal of a function generator circuit 72. The circuit 72 has an input terminal connected to the output terminal of converter 40 for receiving the signal representative of the velocity of the vehicle 12.

The function generator circuit 72 may be of any of the types well known in the art for providing an output signal as a predetermined function of an input signal. In the preferred embodiment the circuit 72 is arranged to provide an output signal in response to either very small or very large amplitude input signals. The arrangement is such that for vehicle velocities between, for example, 3 and 50 miles per hour, the circuit 72 has no effect on the output signal from summing junction 70. For velocities less than 3 miles per hour the circuit 72 clamps the deceleration rate signal 'a' to a predetermined small value. For velocities greater than 50 miles per hour, the circuit 72 clamps the rate signal 'a' to a predetermined relatively large value. A more detailed discussion of this function is discussed hereinafter with regard to FIG. 6.

The control system of FIG. 2 also provides for velocity control of the vehicle 12 in response to velocity command signals from wayside signal devices. Thus, the system includes a velocity command receiver 74 preferably of the type described in the aforementioned U.S. Pat. No. 3,334,224. The signals received by receiver 74 are coupled to a velocity reference generator 76 which decodes the received signals and provides a direct current velocity reference output signal whose voltage amplitude is representative of the commanded velocity. Reference generator 76 may also be of the type described in U.S. Pat. No. 3,334,224. The velocity reference signal is coupled to a summing junction 78 where it is algebraically summed with the velocity feedback signal from converter 40 to generate a velocity error signal.

In the embodiment of FIG. 2 the velocity error signal is modified by an additional compensation signal coupled to a third input terminal of summing junction 78 from a function generator 80. The compensation signal provides a bias voltage which is summed with the velocity reference signal to produce a larger magnitude velocity error signal as vehicle velocity increases. The larger magnitude velocity error signal is used to compensate for increases in wind drag with increasing velocity. Since the compensation signal is necessarily a function of velocity, the velocity feedback signal from converter 40 is coupled to an input terminal of function generator 80 and provides a reference for developing the compensation signal. The compensation signal may be a linear or non-linear function of the velocity feedback signal depending upon the dynamics of the vehicle 12 and the capability of the motors and power system driving the vehicle. Function generators suitable for such applications are well known in the art and will not be detailed herein.

The velocity error signal is coupled from summing junction 78 through an amplifier 82 to a second input terminal of analog "OR" circuit 64. OR circuit 64, which may be a diode OR circuit, is arranged such that the most restrictive of either the velocity error signal or the brake control error signal is coupled through onto conductor 66 to thereby become the tractive effort signal controlling the application of power to the motors of vehicle 12.

An additional feature incorporated into the present inventive tractive effort control system includes a brake anticipation circuit 84 which anticipates the entrance of the vehicle into a braking mode and is adapted to reduce the vehicle tractive effort signal on conductor 66 in order to smooth the transition from a propulsion mode into the position stop mode. The brake anticipation circuit 84 is enabled by a signal from logic circuit 44 via conductor 86. The distance-to-go error signal at the output terminal of summing junction 56 is coupled via conductor 88 to a second input terminal of anticipation circuit 84. If the distance-to-go error signal is less than a predetermined positive value (as indicated by a small signal on the conductor 88) and the train is moving at a relatively high speed (as indicated by a large linear velocity signal), the brake anticipation circuit 84 generates an output signal of a predetermined magnitude which is applied to a third input terminal of analog OR circuit 64. The signal from anticipation circuit 84 clamps the tractive effort signal to the predetermined magnitude thereby calling for a braking rate which permits a smoother transition onto the program stop profile if the train is moving too fast when the receiver 42 on the lead vehicle passes the first or outermost one of the cooperating wayside signal devices 24 and 26 as the desired stopping point is approached. In an exemplary embodiment, a braking rate of 0.7 miles per hour per second was selected to provide a smooth transition. The output signal of the brake anticipation circuit 84 becomes ineffective once the vehicle 12 begins to approximate the predetermined velocity/distance profile. This feature will be explained more fully hereinafter in conjunction with the description of FIGS. 6 and 7.

The normally open switch 60, illustrated as a relay contact but which may be a solid state switch such as a junction field effect transistor, is closed by a signal from logic circuit 44 generated in response to entry into the program stop mode of operation. In the event that it is not desired to stop the vehicle 12 at the approaching station, there is provided a manually operable bypass switch 90 which, when closed, forces the logic circuit 44 to de-energize switch 60 so that the vehicle 12 operates in response to only the velocity error signal. Closing of the bypass switch 90, however, does not affect the operation of the distance-to-go circuitry and accordingly, the distance-to-go error at the output of summing junction 56 continues to be updated. This permits the vehicle 12, within reasonable limits, to be forced back onto the programmed velocity/distance profile in the event that it is subsequently decided to stop at the approaching station and the bypass switch 90 is released.

Figures 3, 3B:
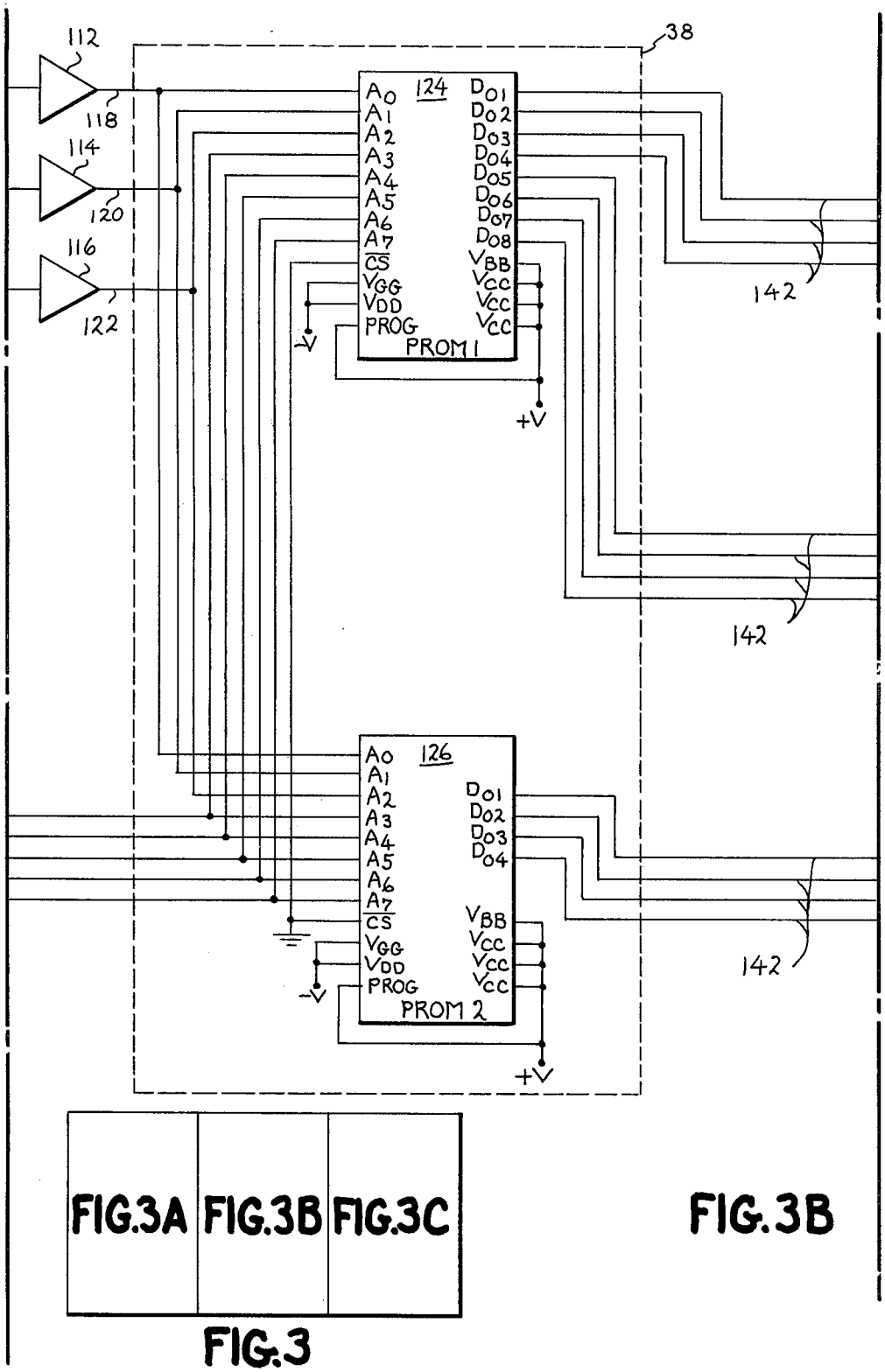
FIG. 3, comprising the drawing sheets labeled 3A, 3B, and 3C is a more detailed drawing of the distance computing portion of the system of FIG. 2.
Figure 3A:
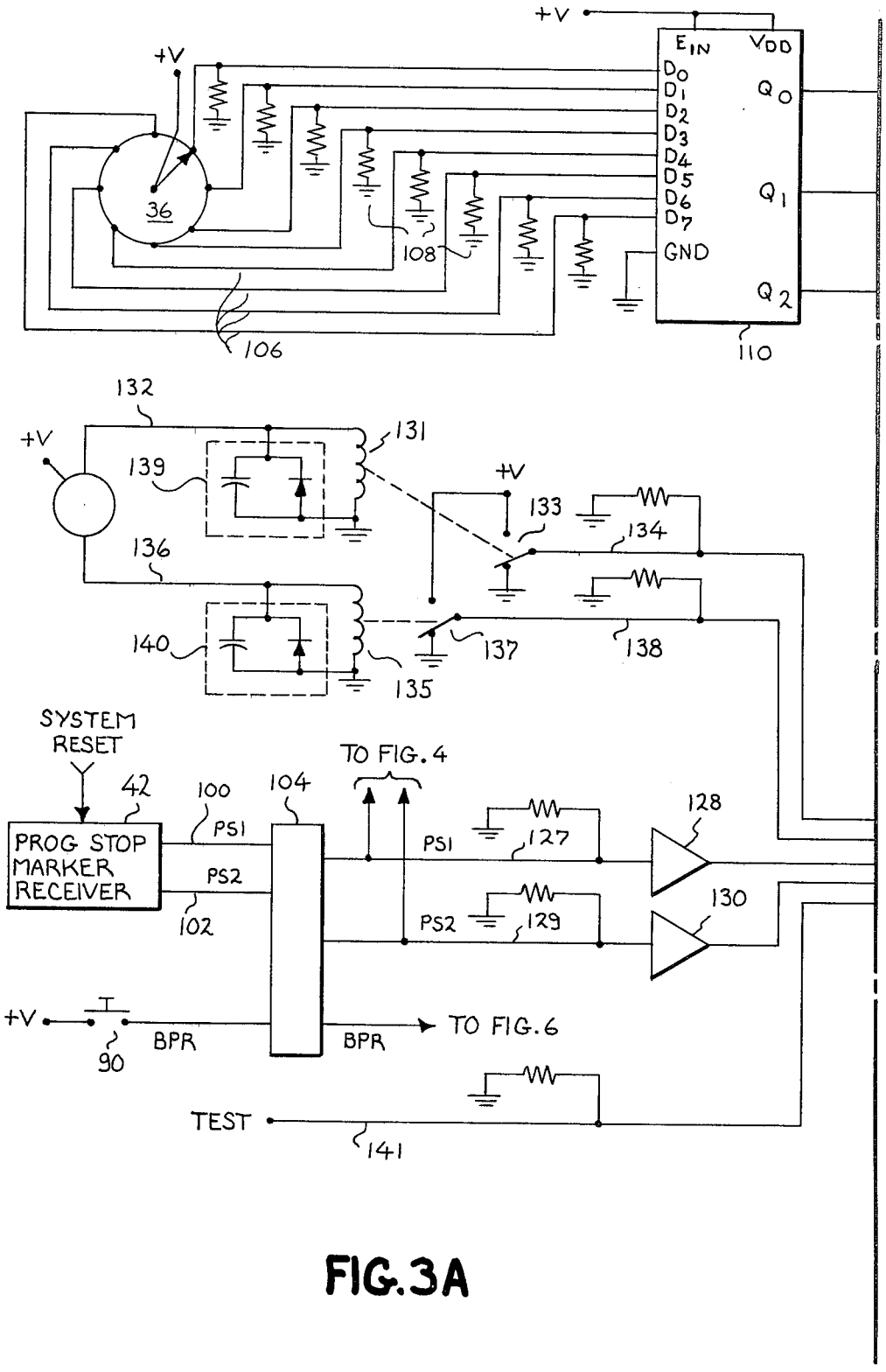
Figure 3C:
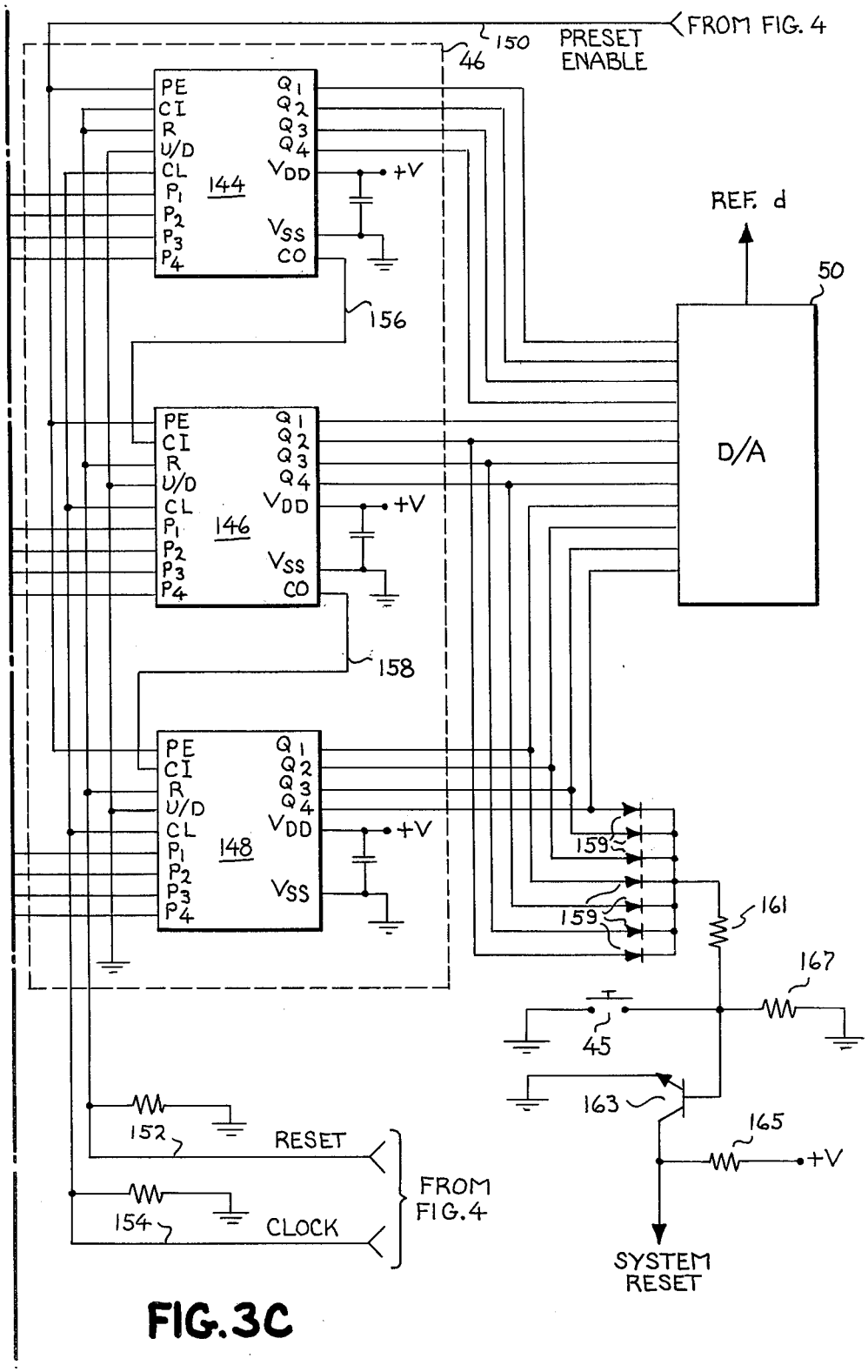

Referring now to FIG. 3, which is divided into three sheets labeled FIGS. 3A, 3B, and 3C, there is shown a more detailed arrangement of the digitally implemented program stop control circuit of FIG. 2. For purposes of explanation the ATO system will be assumed to have two check points prior to reaching a predetermined stopping point or station, each check point having a wayside signal device for generating a position signal receivable by the passing vehicle. The program stop marker receiver 42 operates in the manner described in the aforementioned U.S. Pat. No. 3,334,224 to provide a first signal indicated as PS1 on a first conductor 100 when the outermost distant signal device is passed and a second signal indicated as PS2 on a second conductor 102 when the next distant signal device is passed. Preferably the PS1 and PS2 signals are generated by closure of relay contacts in the manner described in U.S. Pat. No. 3,334,224. Preferably also, the relay logic is so arranged that a system reset signal can be applied to force all relays to their initialized condition. Since the signals PS1 and PS2 are generated by actuation of relay contacts, both signals are coupled through a contact bounce eliminator 104 of a type well known in the art. The contact bounce eliminator 104 may be, for example, a type MC 14490 as shown and described on pages 8–30 et seq. of Volume 5, Series A of *The Semiconductor Data Library, McMOS Integrated Circuits,* published in 1975 by Motorola Semiconductor Products, Inc. Another stage of the eliminator 104 is also used to shape the station bypass signal BPR produced when the switch 90 is closed.

The wheel diameter compensation switch 36 is preferably selected as having eight positions although more or less could be chosen as desired. Each position of the switch 36 energizes a different one of the conductors 106 thus indicating a different wheel diameter. A plurality of bleeder resistors 108 are connected to each of the conductors 106. The switch 36 is manually set to correspond to a measured wheel diameter.

The conductors 106 are connected respectively to corresponding input terminals $D_0$ through $D_7$ of a priority encoder 110. The encoder 110 may be, for example, an MC 14532 encoder as shown and described in the aforementioned Motorola *Semiconductor Data Library,* Volume 5, Series A on pages 7–247 et seq. The encoder 110 determines which of the conductors 106 is energized and provides a three-bit binary address code on its output terminals $Q_0$, $Q_1$ and $Q_2$ identifying the energized one of the conductors 106. For the present application, the encoder 110 is continuously enabled by application of a positive voltage V+ to its enable input terminal $E_{IN}$.

The output terminals $Q_0$, $Q_1$, and $Q_2$ of encoder 110 are connected respectively to corresponding input terminals of identical buffer amplifiers 112, 114 and 116 of a type well known in the art. For simplicity, the power supply connections to these amplifiers, being well known, are not illustrated. The output signals generated by the amplifiers 112, 114 and 116 form the first three bits of a binary address code which is used to locate, in the memory device 38, the number representative of the number of wheel revolutions required to reach the predetermined stopping point.

Conductors 118, 120, and 122 connected respectively to the output terminals of amplifiers 112, 114 and 116 couple the binary signals produced by the amplifiers to corresponding input terminals of memory device 38. In its preferred embodiment the memory device 38 comprises two programmable read only memory units (PROM) 124 and 126. Each PROM may be, for example, a type 1702A manufactured by Intel Corporation and shown and described in their Component Data Catalog for 1979. The corresponding input terminals of each of the PROM's 124 and 126 are connected in parallel so that an eight bit address code will address a twelve bit binary number. In the present embodiment, the binary signals from amplifiers 112, 114 and 116, representing wheel diameter, are coupled to the $A_0$, $A_1$ and $A_2$ input terminals of PROM's 124 and 126.

The balance of the input address code for PROM's 124 and 126 is provided by the train length switch 34 and the combination of the PS1 and PS2 signals from the program stop marker receiver 42. The PS1 signal is coupled via conductor 127 through an amplifier 128 to the $A_5$ input terminals of PROM's 124 and 126. Similarly, the PS2 signal is coupled via conductor 129 through an amplifier 130 to the $A_6$ input terminals of PROM's 124 and 126.

The illustrative system is adapted to be utilized with a train of vehicles not exceeding eight cars in length. However, it will be obvious that the system is readily adaptable to accommodate larger numbers of vehicles. It is also apparent that stopping a train of vehicles so that the center of the train is at the mid-point of a station will result in a vehicle being centered on the mid-point of the station in the case of a train having an odd number of vehicles whereas a train having an even number of vehicles would stop with the junction between two vehicles being centered on the station mid-point. Accordingly, it is preferable to adjust the train center point for stopping purposes as a function of an odd number of vehicles. For example, the lead vehicle in a train of one vehicle or two vehicles will stop with its center at the station mid-point. Similarly, the second vehicle in a train of three vehicles or four vehicles will stop with its center at the station mid-point.

In order to stop the train in the manner described, the train length selector switch 34 is set to the position indicative of the number of vehicles in the train. In the one or two vehicle position, the switch 34 energizes a relay coil 131 via a conductor 132 causing relay contact 133 to be picked up and couple a voltage V+ onto a conductor 134. In the three or four vehicle position, the switch 34 energizes a relay coil 135 via a conductor 136 causing relay contact 137 to be picked up and couple the voltage V+ onto a conductor 138. In the five or six vehicle position, the switch 34 energizes both relay coils 131 and 135 thereby coupling the voltage V+ onto both conductors 134 and 138. In the seven or eight vehicle position, neither relay coil 131 nor 135 is energized and both conductors 134 and 138 are grounded. As shown, both relay coils 131 and 135 are shunted by respective voltage spike suppression circuits 139 and 140. Adaptation of a multi-position switch such as switch 34 to produce the described logic function is well known to those having ordinary skill in the art.

The conductors 134 and 138 are connected to the $A_3$ $A_4$ input terminals of PROM's 124 and 126. The $A_7$ input terminal of PROM's 124 and 126 are connected via conductor 141 to a test circuit (not shown) which provides a fixed logic signal to the $A_7$ terminal except when the system is in a test mode. Apparatus for providing a self-test mode of operation is well known and will not be discussed herein. As illustrated, appropriate bias supply voltages are furnished to the $V_{BB}$, $V_{CC}$, $V_{GG}$, $V_{DD}$ and PROG input terminals of PROM's 124 and 126, as specified by the manufacturer, to place the PROM's in a READ mode whereby the data addressed by the address lines $A_0$ through $A_7$ is read-out or transferred to the output terminals $D_{01}$ through $D_{08}$ of each PROM. However, since only a twelve bit binary number is desired, the terminals $D_{05}$ through $D_{08}$ of PROM 126 are not used.

The twelve-bit binary number developed at the output terminals of PROM's 124 and 126 is coupled via conductors 142 to corresponding input terminals of counter circuit 46. In a preferred embodiment counter circuit 46 comprises three type MC14516B binary up/-down counters 144, 146 and 148 manufactured by Motorola, Inc. and shown and described on pages 7–190 et seq of the aforementioned Vol. 5, Series A of the *Semiconductor Data Library*. The type MC14516B counter is a four-bit binary counter which can be parallel loaded through its four input terminals $P_1$ through $P_4$, with $P_1$ being the least significant bit (LSB) and $P_4$ the most significant (MSB). The twelve bit binary number from PROM's 124 and 126 is sufficient to fully load all three counters 144, 146 and 148. Each of these counters has its up/down (U/D) control terminal grounded so that counting is always down, i.e., the counters count from a high positive number toward zero. A PRESET ENABLE signal is coupled via conductor 150 to the Preset Enable (PE) terminals of each counter 144, 146 and 148 from control logic circuit 44. Control logic circuit 44 also supplies a RESET signal via conductor 152 to the Reset (R) terminals and a CLOCK signal via conductor 154 to the Clock (CL) terminals of the counters 144, 146, and 148. Since the three counters 144, 146, and 148 are to function as a single 12 bit counter, the carry out (CO) output terminal of counter 144 is connected via conductor 156 to the carry in (CI) input terminal of counter 146 and the carry out terminal of counter 146 is connected via conductor 158 to the carry in input terminal of counter 148. An appropriate biasing voltage as specified by the manufacturer is applied to the $V_{DD}$ terminals of each of the counters and the $V_{SS}$ terminals are each grounded.

The type MC14516B counters require that CLOCK signals applied to the clock terminals be removed prior to transferring data into the counter registers. In addition the transfer of information into the counters occurs in response to a logical 1 or positive voltage signal being applied to the preset enable (PE) terminals of each of the counters. The implementation of the logic circuit for generating the PRESET ENABLE pulses and for inhibiting the CLOCK signals during transfer of data to the counters 144, 146, and 148 will be discussed hereinafter with respect to FIG. 4.

Continuing with FIG. 3, for the present embodiment the $Q_1$ output terminal of counter 144 represents the least significant bit (LSB) of the twelvebit number developed by the three counters 144, 146 and 148. The binary bit developed at the $Q_4$ output terminal of counter 148 represents the most significant bit (MSB) of the number developed by the counters. The output terminals $Q_1$ through $Q_4$ of each of the counters 144, 146 and 148 are connected in parallel to twelve input terminals of the digital-to-analog converter (D/A) 50. Such a D/A converter may be, for example, a type DAC-85 12-bit D/A converter available from Burr-Brown Research Corp., Tucson, Ariz. Appropriate bias voltages are applied to terminals of the DAC-85 as specified by the manufacturer. As indicated previously, the signal developed at the output terminal of D/A converter 50 on conductor 220 represents the distance-to-go reference signal 'd.'

If the station stop is bypassed, i.e., if switch 90 is closed so that the system is maintained in a velocity control mode rather than a program stop control mode, the counters 144, 146 and 148 will continue to count down even though the output signals are not used for stopping the vehicle 12. In a preferred implementation the system generates a stop signal prior to the counter reaching zero counts. In order to reset the program stop system when a station stop is bypassed, a logic circuit is provided for monitoring the count in the counters 144, 146 and 148 and for generating a SYSTEM RESET signal when the count reaches a predetermined value. The logic system comprises a plurality of diodes 159 connected to selected output terminals of counters 146 and 148 in a logical OR gate arrangement so as to produce a logical zero output signal whenever the count remaining in the counter 46 is equivalent to a decimal count of 31. In the OR gate arrangement the cathodes of the diodes 159 are each connected through a resistor 161 to a base terminal of an NPN transistor 163. The emitter terminal of transistor 163 is connected to ground potential whereas its collector terminal is connected to a relatively positive voltage V+ through a resistor 165. A base bias resistor 167 is also connected between the base terminal of transistor 163 and ground potential. When a logical zero signal is developed at the base terminal of transistor 163, the transistor 163 is rendered non-conducting and the positive voltage V+ connected to the resistor 165 appears at the collector terminal of transistor 163. The positive voltage signal at the collector terminal of transistor 163 is used as the SYSTEM RESET signal.

When the vehicle 12 is permitted to stop at a station, the tach pulses are no longer generated and the counter 46 ceases counting down. When the vehicle operator closes the START switch 45, one set of contacts of the switch 45 are connected to apply a logical zero or ground potential to the base terminal of transistor 163. Accordingly, when the vehicle 12 is commanded to depart from a station, a SYSTEM RESET signal is developed at the collector terminal of transistor 163.

Figure 4:
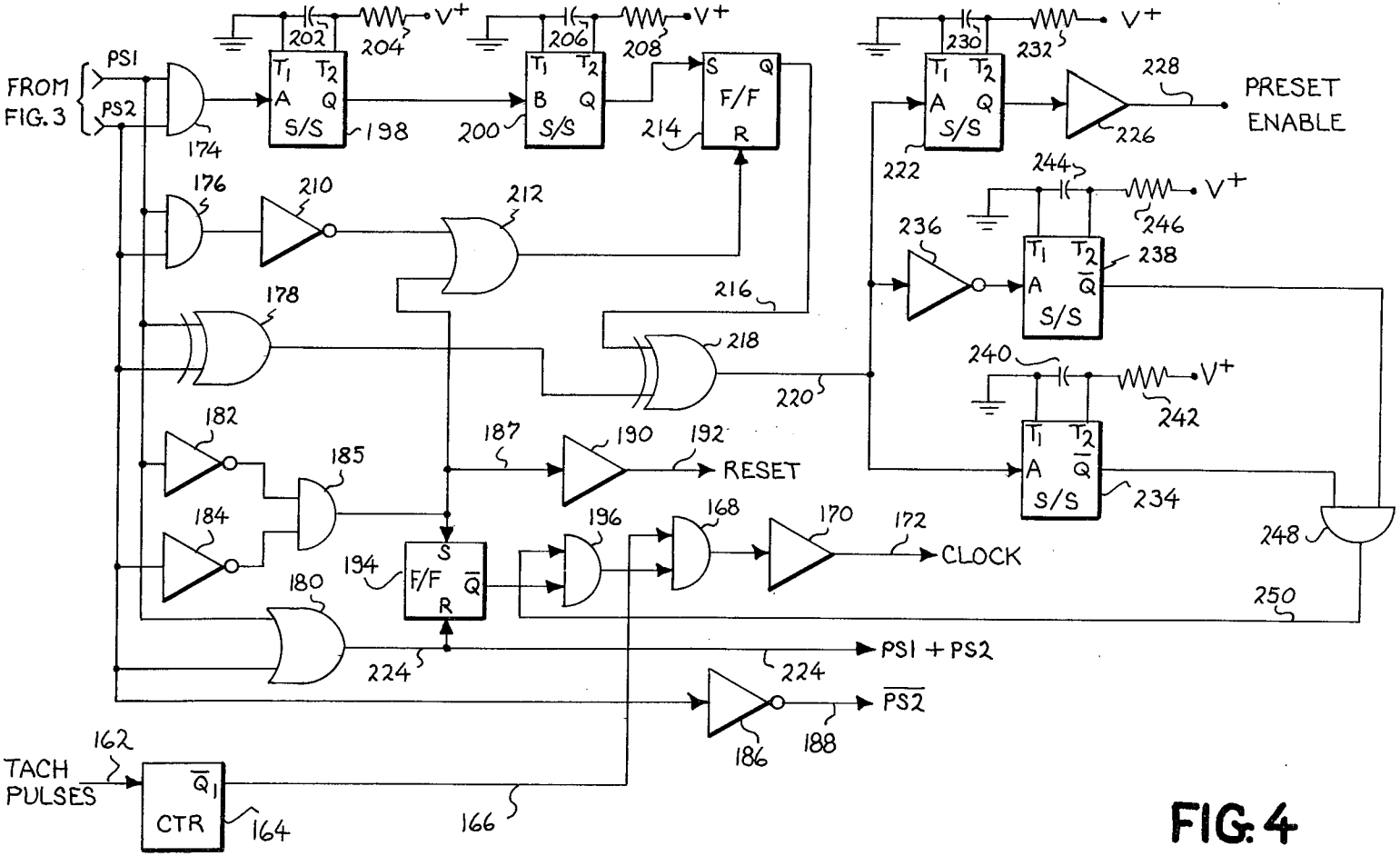
FIG. 4 is a schematic representation of the logic portion of FIG. 2 which controls the distance computing portion.

Referring now to FIG. 4, there is shown a detailed embodiment of the circuitry for generating the PRESET ENABLE signal, the RESET signal and the CLOCK signals which are applied to the counters 144, 146, and 148. The tachometer pulses developed by speed sensor 32 and shaped by pulse shaper circuit 48 are coupled via conductor 162 to a data input terminal of a counter 164. The counter 164 is of a type well known in the art such as, for example, a type MC-14018B available from Motorola Semiconductor Products, Inc., which is so connected that an output signal is provided on conductor 166 for a predetermined number of tach pulses. In the illustrative system one output signal for each 8 counts is utilized. The signals developed on conductor 166 are coupled through an AND gate 168 and an amplifier 170 at which point they become CLOCK signals. A conductor 172 conveys the CLOCK signals to the clock input terminals 'CL' of the counters 144, 146, and 148. As indicated previously the counters 144, 146, and 148 require that the CLOCK signals be interrupted prior to loading additional data into the counter registers. The AND gate 168 provides this interruption function in a manner to be described below.

The PS1 and PS2 signals from contact bounce eliminator 104 (shown in FIG. 3) are coupled into a plurality of parallel connected circuits. As explained previously, the PS1 signal is generated when the vehicle passes the outermost program stop signal device. The PS1 signal thereafter stays at a high or logical 1 level until a system reset occurs. The PS2 signal is generated when the vehicle passes the second program stop signal device and it also thereafter stays at a high or logical 1 signal level until a SYSTEM RESET signal is produced. The PS1 and PS2 signals are applied in parallel to first and second input terminals of an AND gate 174, to first and second input terminals of an AND gate 176, to first and second input terminals of an exclusive OR circuit 178, to first and second input terminals of an OR circuit 180, and to respective input terminals of inverting amplifiers 182 and 184. In addition the PS2 signal is applied to an input terminal of an inverting amplifier 186 to develop on a conductor 188 a signal corresponding to $\overline{PS2}$, i.e., a signal which is a logical inversion of PS2. The $\overline{PS2}$ signal is not used in the preset enable or reset circuitry but is developed here for application in that part of the program stop control logic circuit 44 shown in FIG. 6.

Turning first to the inverting amplifiers 182 and 184, the output terminal of inverting amplifier 182 is connected to a first input terminal of an AND gate 185. The output terminal of inverting amplifier 184 is connected to a second input terminal of the AND gate 185. By definition an AND gate provides a logical 1 output signal only when all of its input terminals are supplied with a logical 1 input signal. Accordingly, when the vehicle has not entered into the program stop mode of operation so that both PS1 and PS2 signals are at a logical 0 level, the inverters 182 and 184 provide logical 1 input signals to both of the input terminals of AND gate 185. The output signal developed at an output terminal of AND gate 185 is therefore at a logical 1 level. The output terminal of AND gate 185 is coupled via a conductor 187 to an amplifier 190 which provides the RESET signal on a conductor 192. The output terminal of AND gate 185 is also coupled to the set input terminal of a flip flop 194. A reset terminal of flip flop 194 is connected to an output terminal of OR gate 180, which gate 180 develops on a conductor 224 a signal corresponding to PS1+PS2, i.e., a signal which is a logical 1 whenever PS1 or PS2 or both are at logical 1 levels. As will be apparent, prior to entering the program stop mode of operation, the output signal developed by OR gate 180 will be a logical 0 and since the signal developed by AND gate 185 is a logical 1, the flip flop 194 will be in a set mode. In the set mode of operation the Q output terminal of flip flop 194 will be at a logical 1 level and the Q output terminal will be at a logical 0 level.

The $\overline{Q}$ output terminal of flip flop 194 is connected to an input terminal of AND gate 196. An output terminal of AND gate 196 is connected to an input terminal of AND gate 168. Accordingly, when flip flop 194 is in a set mode, a logical 0 applied to an input terminal of AND gate 196 from the $\overline{Q}$ output terminal of flip flop 194 will cause the output signal developed by AND gate 196 to be a logical 0 which in turn being applied to AND gate 168 will provide a logical 0 output signal from this latter AND gate. Since AND gate 168 is connected to control the application of the CLOCK signals being developed on line 172, the presence of a logical 0 on one of its input terminals will result in inhibiting the CLOCK signals. Thus, whenever the vehicle has not entered into the program stop mode of operation, CLOCK signals are inhibited.

The AND gates 174 and 176 both provide logical 0 output signals as a result of both the PS1 and PS2 input signals being at logical 0 levels. The output terminal of AND gate 174 is connected to an input terminal of a monostable multivibrator 198. The multivibrator may be, for example, the type MC 14528 as shown and described in the aforementioned *Semiconductor Data Library* published by Motorola Semiconductor Products, Inc. The type MC 14528 is a single package unit having two single shot multivibrators constructed therein. An output terminal of multivibrator 198 is connected to an input terminal of the second multivibrator 200. The multivibrator 200 is identical to the multivibrator 198 and, in this particular instance, may be a second unit in the same package as the multivibrator 198.

The multivibrator 198 is connected to produce a 5 microsecond pulse beginning at the leading edge of a logical 1 signal generated by the AND gate 174. The multivibrator 200 is adapted to provide a 10 microsecond pulse beginning at the trailing edge of the 5 microsecond pulse produced by multivibrator 198. The pulse timing duration is set on the two multivibrators 198 and 200 by the external capacitor resistor combinations comprised of capacitor 202 and resistor 204 and capacitor 206 and resistor 208. The connections to the various terminals of the two multivibrators with bias voltages and reference grounds are made as recommended by the manufacturer in the aforementioned *Semiconductor Data Library* text. As will be apparent, neither of the multivibrators 198 nor 200 will be triggered to provide any output signals until both the PS1 and PS2 signals attain logic 1 levels.

Initially the output signal developed by AND gate 176 will be at a logical 0 level as a result of the PS1 and PS2 signals being at logical 0 levels. The output terminal of AND gate 176 is connected to an input terminal of an inverter 210. An output terminal of inverter 210 is connected to a first input terminal of an OR gate 212. A second input terminal of OR gate 212 is connected to the output terminal of AND gate 185. An output terminal of OR gate 212 is connected to a RESET terminal 'R' of a flip flop 214. A SET terminal 'S' of flip flop 214 is connected to the Q output terminal of multivibrator 200. Prior to entering into the program stop mode the output signal developed by multivibrator 200 will be at a logical 0 level and the output signal developed by OR gate 212 will be at a logical 1 level thus forcing the flip flop 214 to be in a reset mode. In the reset mode flip flop 214 will provide at a Q output terminal a logical 0 signal which is connected via conductor 216 to a first input terminal of an exclusive OR gate 218.

A second input terminal of exclusive OR gate 218 is connected to an output terminal of exclusive OR gate 178. As is well known the exclusive OR gate will provide a logical 1 output signal only when the signals applied to its two input terminals are at different logical levels. With PS1 and PS2 both at a logical 0 level, exclusive OR gate 178 will produce a logical 0 level which thus results in both input signals to exclusive OR gate 218 being at a logical 0 level and forces the output signal from exclusive OR gate 218 to be at a logical 0 level.

The output terminal of exclusive OR gate 218 is connected via a conductor 220 to an input terminal of a single shot multivibrator 222, which multivibrator is identical to the multivibrator 198. The Q or non-inverting output terminal of multivibrator 222 is connected through an amplifier 226 to a conductor 228 on which is developed the PRESET ENABLE signal. The time duration of the PRESET ENABLE signal on conductor 228 is determined by the timing capacitor 230 and resistor 232 connected to the timing terminals of multivibrator 222. For the present application a time duration of 10 microseconds is considered adequate.

Figure 5:
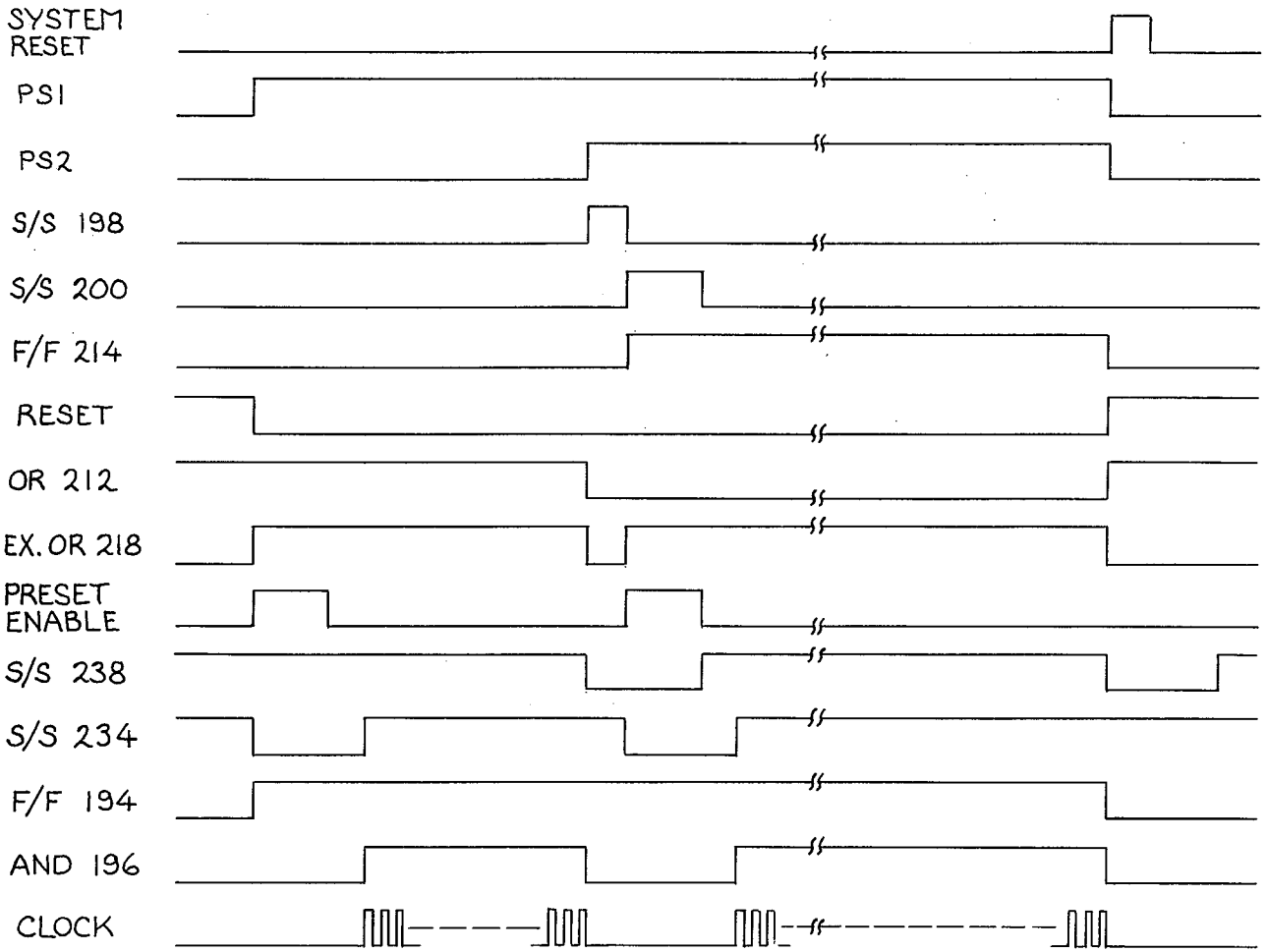
FIG. 5 is a timing diagram useful in conjunction with FIG. 4.

During the preset enable time it is also necessary to inhibit the clock pulses to the counters 144, 146, and 148 and to this end the output signal developed by exclusive OR circuit 218 is also applied to a one shot multivibrator 234 and through an inverter 236 to a second one shot multivibrator 238. The multivibrators 234 and 238 are provided with identical resistor capacitor timing circuits comprising with respect to multivibrator 234, a capacitor 240 and resistor 242 and, with respect to multivibrator 238, a capacitor 244 and resistor 246. Both of these multivibrators 234 and 238 are identical to the multivibrator 198 and are thus connected with appropriate bias voltages as recommended by the manufacturer. The inverted or $\overline{Q}$ output terminal of multivibrator 238 and the inverted or $\overline{Q}$ output terminal of multivibrator 234 are connected, respectively, to first and second input terminals of an AND gate 248. An output terminal of AND gate 248 is connected via a conductor 250 to an input terminal of AND gate 196. Since the AND gate 248 is connected to the inverted output terminals of the multivibrators 234 and 238, the output signal developed by AND gate 248 will be at a logical 1 level except for the short time interval just after a PS1 or PS2 signal is generated. During that short time interval the output of AND gate 248 will be at a logical 0 level and will inhibit the operation of AND gate 196 which in turn will inhibit ANG gate 168 thereby preventing the passage of clock pulses onto conductor 172. Before proceeding with a discussion of the operation of the circuit of FIG. 4, it should be recalled that the purpose of the circuitry described in FIG. 4 is simply to permit the transfer of data from the memory device 38 into the counters forming the counter circuit 46. A better understanding of the operation of the circuit of FIG. 4 may be had by reference to the timing diagrams shown in FIG. 5 in conjunction with the following description of FIG. 4. Prior to entering into the program stop mode, both the PS1 and PS2 input signals are at a logical 0 level and, by virtue of the inversion of both of these signals through the inverters 182 and 184, the RESET signal is maintained at a logical 1 level. As soon as the program stop mode is entered and a wayside signal device detected, a PS1 signal is generated and the RESET signal, as shown in FIG. 5, immediately drops to a logical 0 level. Clearly the AND gates 174 and 176 are not affected by the reception of a PS1 signal. However, the exclusive OR gate 178 does respond to the PS1 signal and generates a logical 1 signal which is coupled through the exclusive OR gate 218 so that a trigger is applied to the one-shot multivibrator 222 to generate a 10 microsecond PRESET ENABLE pulse. The logical 1 signal produced by the exclusive OR gate 218 is also applied to the two one-shot multivibrators 234 and 238. Multivibrator 234 is triggered by the leading edge of the signal from gate 218. However, multivibrator 238 is responsive to the trailing edge of the gate 218 signal due to the presence of inverter 236. Both multivibrator 234 and multivibrator 238 are arranged to provide 15 microsecond output pulses. The combination of the pulses from multivibrators 234 and 238 in AND gate 248 results in a 15 microsecond inhibit when a PS1 signal is detected and a 20 microsecond inhibit when a PS2 signal is detected. The inhibit function is implemented by coupling the signals from AND gate 248 to AND gate 196. Thus, whenever a logical signal is developed by AND gate 248, that signal will force a logical 0 signal to be applied to AND gate 168 and prevent the production of clock signals on conductor 172.

It will be noted from the timing diagram that the flip flop 194 serves to prevent clock pulses from being coupled onto conductor 172 only during the time when neither PS1 nor PS2 signals have been received. Once either a PS1 or a PS2 signal has been detected, flip flop 194 is placed in a reset condition whereby a logical 1 signal is applied to the AND gate 196. With flip flop 194 reset, control of the production of clock signals depends upon the signal developed by the AND gate 248. The time delay established by multivibrator 234 has been set at 15 microseconds since that time is adequate to permit data to be transferred into the counters 144, 146, and 148. Once this multivibrator has timed out, the inhibit provided by it is released and clock pulses are again permitted to pass through the AND gate 168.

Upon receipt of a PS2 signal, the AND gate 174 is enabled and a trigger is applied to multivibrator 198 which thereafter generates a 5 microsecond pulse. The 5 microsecond pulse is supplied to the inverting input terminal of multivibrator 200 so that the output pulse generated by multivibrator 200 is coincident with the trailing edge of the pulse generated by the multivibrator 198. The relationship between these two pulses is shown in the timing diagram of FIG. 5. The leading edge of the pulse generated by multivibrator 200 is applied to a set input terminal of the flip flop 214 thus causing its Q output terminal to go to a logical 1 level. The Q output terminal of flip-flop 214, being coupled by conductor 216 to exclusive OR gate 218, provides a gate signal via conductor 220 to the multivibrator 222 for generating a PRESET ENABLE signal. Coincident with the generation of the PRESET ENABLE signal, the signal on conductor 220 also causes multivibrator 234 to trip thus inhibiting the production of clock pulses by providing logical 0 signals through AND gate 248 and AND gate 196 to the AND gate 168. Multivibrator 234 is triggered 5 microseconds after multivibrator 238 trips so that the total clock signal interruption time period is 20 microseconds.

As shown in the timing diagram of FIG. 5, a PRESET ENABLE signal is generated upon reception of a PS1 or PS2 signal so that the data stored in the memory device 38 can be transferred from the memory device to the counter 46. At the same time that a PRESET ENABLE signal is generated, an inhibit is provided to stop the production of clock pulses to the counters 46. The particular time delays provided by the circuitry of FIG. 4 are necessitated by the particular characteristics of the counters comprising counter 46. In the event that other types of counters were used within the counter 46, the circuitry may be adapted to that type of counter.

Figures 6, 6B:
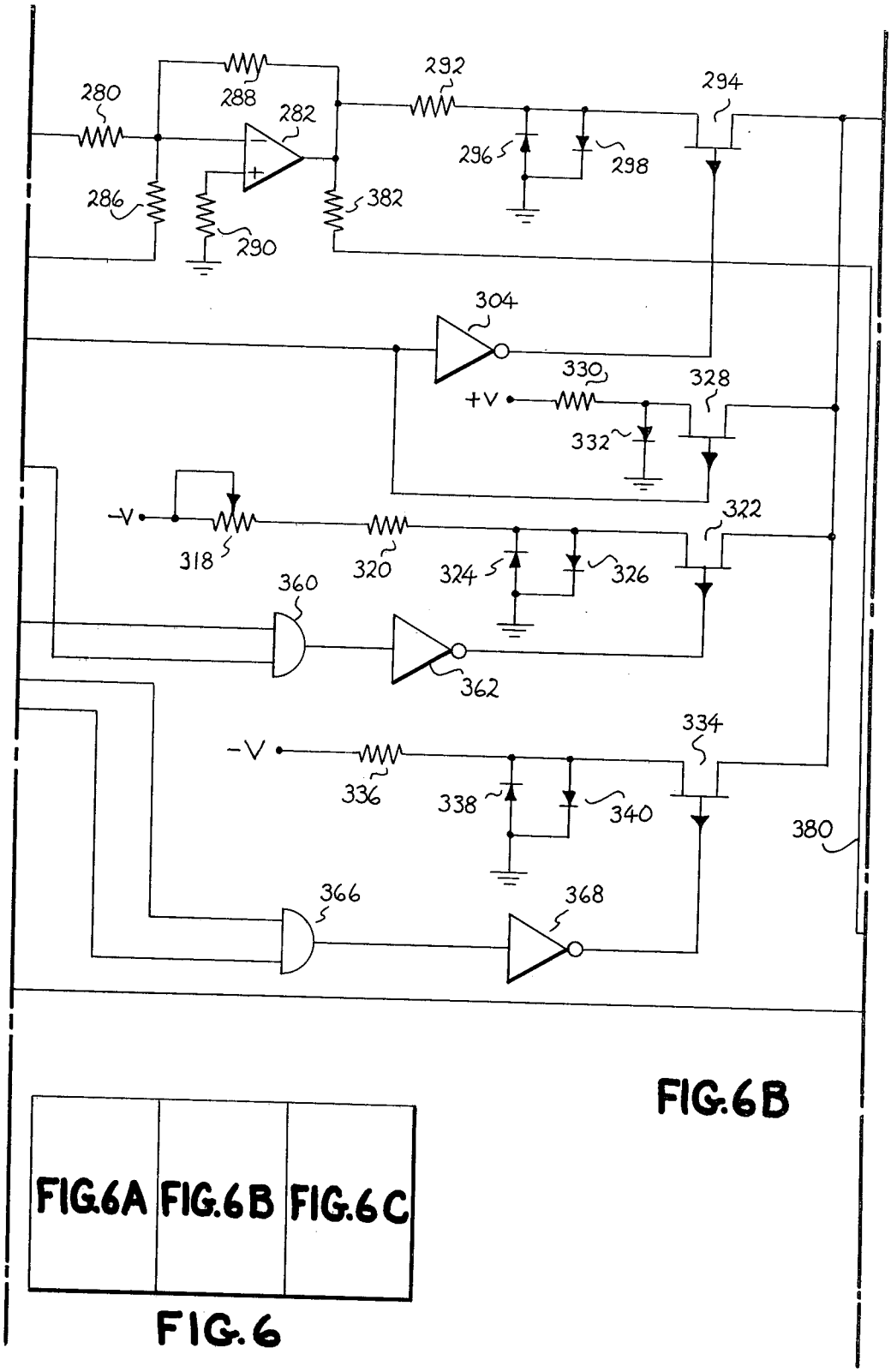
FIG. 6, which comprises the three sheets labeled 6A, 6B, and 6C is a schematic representation of the braking rate regulating portion of FIG. 2.
Figure 6A:
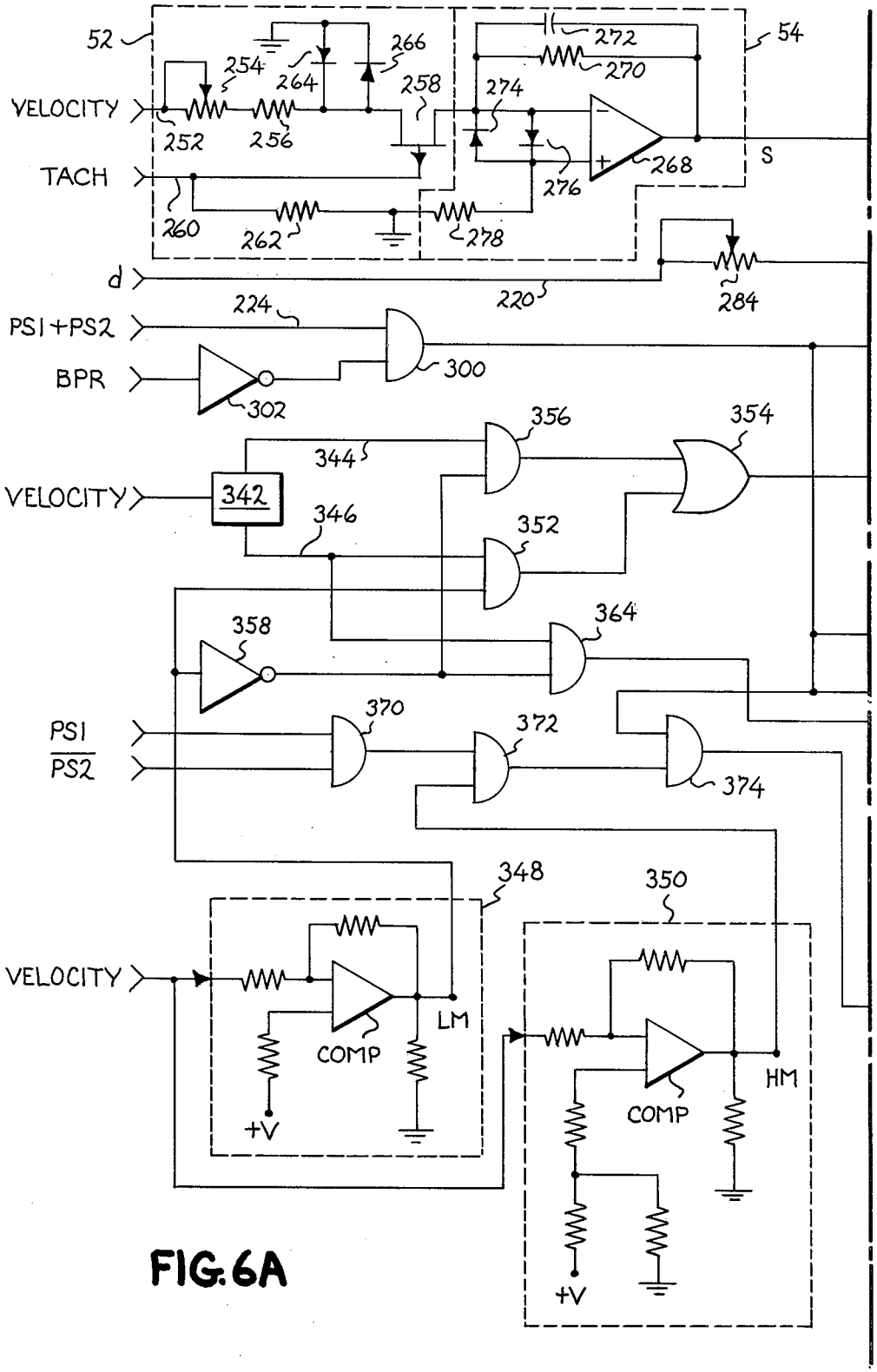
Figure 6C:
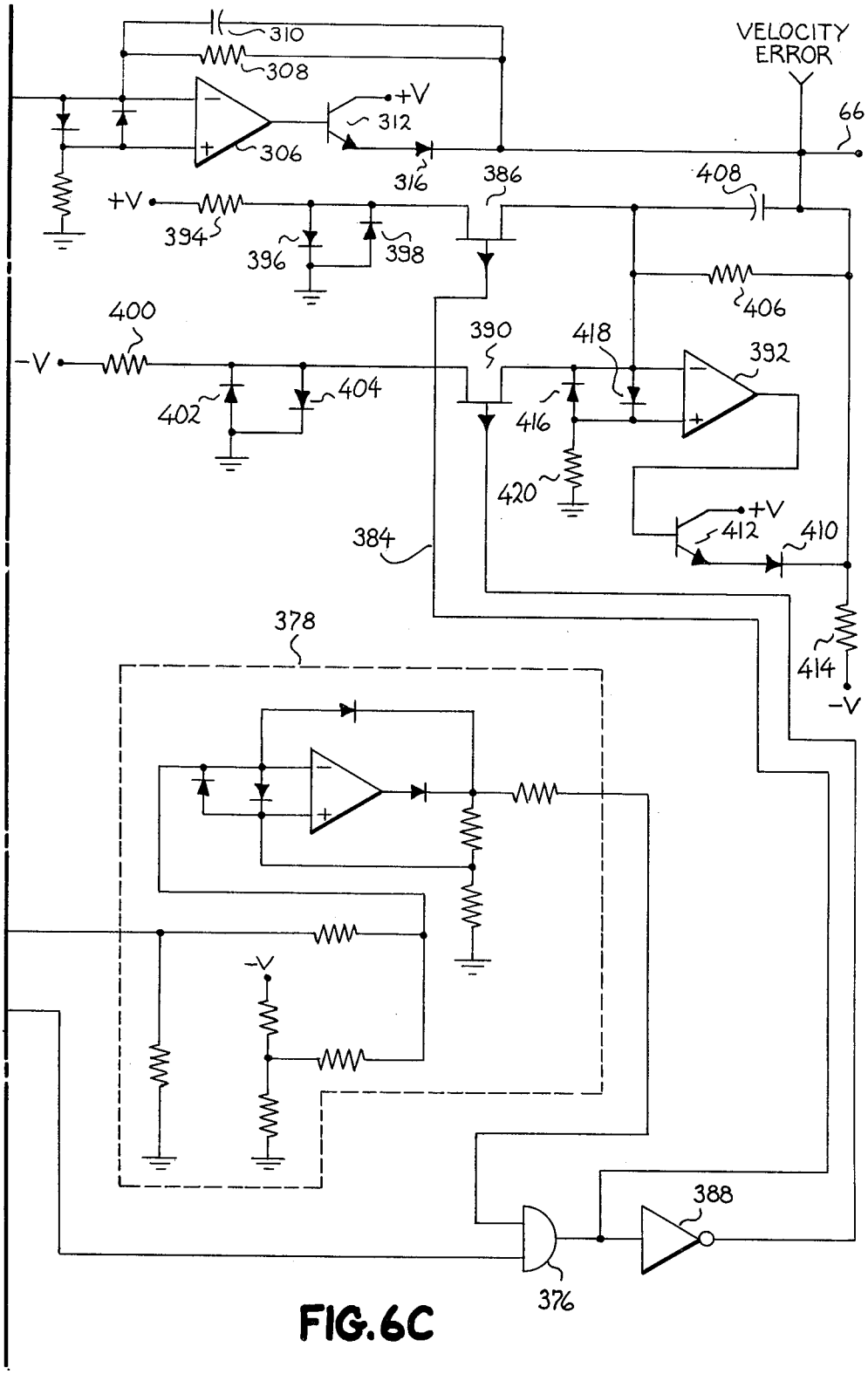

Referring now to FIG. 6, which comprises the three sheets labeled FIG. 6A, FIG. 6B, and FIG. 6C, there is shown a more detailed illustration of the circuitry for developing the tractive effort control signal from the distance-to-go reference signal and the distance-to-go feedback signal based upon the desired acceleration rate signal. As indicated previously, the distance-to-go feedback signal is computed as the quotient of the square of actual velocity of the vehicle divided by twice the desired acceleration rate. In FIG. 1 this was illustrated as being accomplished by a multiplier circuit which multiplies a signal representative of the frequency of the pulses generated by the speed sensor by a second signal which is an analog signal whose amplitude is proportional to the frequency of the speed sensor output signals. As shown in FIG. 6, the analog VELOCITY signal developed by the frequency to voltage converter 40 is applied via a conductor 252 through a variable resistor 254 and a fixed resistor 256 to a source terminal of a field effect transistor 258. The field effect transistor 258 is utilized as a switch which is turned off and on by the shaped speed sensor pulses developed by pulse shaper 48. These shaped speed sensor pulses or TACH pulses are applied via conductor 260 to a gate terminal of the field effect transistor 258. A bleeder resistor 262 is connected between the conductor 260 and ground. Inverse parallel connected diodes 264 and 266 are connected from the source terminal of FET 258 to ground to limit the voltage magnitude applied to the source terminal.

The drain terminal of field effect transistor 258 is connected to an inverting input terminal of an amplifier 268. The amplifier 268 is connected in the well known operational mode including a feedback resistor 270 connected between its output terminal and its inverting input terminal and a capacitor 272 connected in parallel with the feedback resistor 270. Inverse parallel connected diodes 274 and 276 are connected between the inverting and non-inverting input terminals of the amplifier 268 in a manner well known in the art. A biasing resistor 278 is connected between the non-inverting input terminal of amplifier 268 and ground. The amplifier is supplied with the appropriate biasing voltages (not shown) as specified by the manufacturer.

The effect of switching transistor 258 by application of the speed sensor pulses is to produce an output signal which is a function of the amplitude of the velocity proportional signal produced at the source terminal of the transistor and a function of the pulse width of the signals applied to the gate terminal of the transistor. Thus, a signal is developed at the drain terminal of transistor 258 which is essentially a pulse width, pulse height product and is therefore proportional to the square of the velocity of the vehicle. The gain of the amplifier 268 is adjusted such that the signal produced at its output terminal is proportional to the square of the velocity, i.e., $V^2$, divided by twice the desired acceleration rate 'a.' The value of the acceleration rate 'a' is controlled by the scaling of the gain of the amplifier 268.

The $V^2/2a$ signal developed by amplifier 268 is coupled through a resistor 280 to a summing junction at an inverting input terminal of an amplifier 282. At the summing junction, which corresponds to summing junction 56 of FIG. 2, the $V^2/2a$ signal is summed with the distance-to-go reference signal 'd' which is coupled to the junction via conductor 220 and resistors 284 and 286. Resistor 284 is a variable resistor which is used to balance the two signals.

Amplifier 282 is connected as an operational amplifier with appropriate resistive feedback indicated at 288. The non-inverting input terminal of amplifier 282 is connected to ground through a bias resistor 290. The signal developed at the output terminal of amplifier 282 therefore represents the distance-to-go error signal, i.e., the algebraic sum of the distance-to-go reference and distance-to-go feedback signals.

The distance-to-go error signal is coupled from the output terminal of amplifier 282 through a resistor 292 to a source terminal of a field effect transistor (FET) 294. A pair of inverse parallel connected diodes 296 and 298 connected between the source terminal of FET 294 and ground limits the voltage applied to the FET source terminal.

The FET 294 is controlled as a function of whether the program stop mode of operation is in effect or whether the system is in a station bypass mode. To this end the PS1+PS2 signal is applied via conductor 224 to a first input terminal of an AND gate 300. The bypass relay signal BPR is applied through an inverter 302 to a second input terminal of the AND gate 300. If the system is not in a bypass mode, the BPR signal is at a logical 1 level and if the system is in the program stop mode, either the PS1 or PS2 signals will be at a logical 1 level. Accordingly, when the system is in the program stop mode and not in a station bypass mode, the output signal developed by AND gate 300 will be a logical 1 signal. This signal is coupled from the output terminal of AND gate 300 through an inverter 304 to the gate terminal of FET 294. A logical 0 or low level signal provided by the inverter 304 will gate the FET 294 into conduction so that the distance-to-go or position error signal is coupled through the FET 294 to its drain terminal.

The drain terminal of FET 294 is connected to an inverting input terminal of an amplifier 306 which is connected in an operational amplifier mode. The feedback loop for the operational amplifier is provided by a resistor 308 and a capacitor 310 which are connected from a cathode terminal of a diode 316 to the inverting input terminal of amplifier 306. The diode 316 has its anode connected to an emitter terminal of a transistor 312 whose base terminal is connected to an output terminal of amplifier 306. The collector terminal of transistor 312 is connected to voltage source V+. The inclusion of the transistor 312 in the feedback loop provides extra current on the output line 66 to drive the control equipment powering the vehicle traction motors. The diode 316 forms part of the analog OR circuit illustrated at 64 in FIG. 2. The signal developed on the line 66 is the tractive effort control signal for the system when in the program stop mode of operation.

As was previously discussed with reference to FIG. 2, the distance-to-go error signal, developed in FIG. 6 at the output of amplifier 282, is summed with the desired deceleration rate signal to develop the tractive effort control signal. The summing operation occurs at the inverting input terminal of the amplifier 306. The desired rate signals may be varied as desired but are generally specified by the system operators to maximize passenger comfort. In the illustrative invention the desired deceleration rate was set at 2.5 miles per hour per second and was achieved by providing a bias current to the drain terminal of the FET 294. This bias current is supplied by connecting a negative voltage source −V through a variable resistor 318 and a fixed resistor 320 to a source terminal of a field effect transistor (FET) 322. A pair of inverse parallel connect diodes 324 and 326 limits the magnitude of voltage applied to the source terminal of FET 322. A drain terminal of FET 322 is connected to the drain terminal of FET 294. The error current applied to the inverting input terminal of amplifier 306 thus represents the sum of the current developed at the drain terminal of FET 322 and the current developed at the drain terminal of FET 294.

The particular implementation of the summing currents occurring at the drain terminal of FET 294 was selected because of a desire to provide a cushion stop mode of operation, i.e., a mode in which the deceleration rate is reduced just prior to stopping to avoid a "jerking" sensation. The cushion stop mode may be implemented at any desired slow linear velocity but would preferably be used at velocities less than ten miles per hour. In a preferred embodiment, cushion stop mode is utilized between the velocities of five and two miles per hour.

In addition to cushion stop, it is desirable to assure that the system is made inoperative when not in a position stop control mode. The biasing function to make the system inoperative is provided through addition of a current to the drain terminal of FET 294 which will actually command motoring rather than braking. This is achieved through an additional field effect transistor (FET) 328 which has its drain terminal also connected to the drain terminal of FET 294. The FET 328 has a source terminal connected through a resistor 330 to a positive voltage source V+. A diode 332 limits the magnitude of voltage developed at the source of the FET 328. The gate terminal of FET 328 is connected to the output terminal of AND gate 300. When the position stop or station mode is not selected, the output signal developed by AND gate 300 will be a logical 0 which will gate FET 328 into conduction and apply a large positive current to the inverting input terminal of amplifier 306 causing it to command a motoring current rather than a braking current.

Another field effect transistor (FET) 334 also has its drain terminal connected to the drain terminal of FET 294 so that a lower value of deceleration as desired for the cushion stop mode may be called for just prior to actual stopping of the vehicle. The source terminal of FET 334 is connected through a resistor 336 to a source of negative voltage V−. The voltage level applied to the source terminal of FET 334 is limited by the inverse parallel connected diodes 338 and 340. Both the FET 322 and 334 are controlled by signals indicating whether the vehicle is moving, whether a PS1 or PS2 mode has been selected and the speed of the vehicle. The ohmic resistance of the series resistor 336 is made much larger than that of resistor 320 in order to call for a smaller brake rate during cushion stop. The FET 334 is effective to control the braking rate only within a very narrow low speed range as will become apparent. By changing the value of the resistor 320 and the gain of the amplifier 268, the system can be adjusted to any desired deceleration rate. Alternatively, additional "stages" of deceleration could be implemented by adding FET networks as desired.

The analog velocity signal generated by the frequency-to-volts converter 40 is applied to a detector circuit 342 which provides an output signal indicative of whether the vehicle is moving or not moving. The circuit 342 may be a simple voltage level detector with a logic output such that a no-motion signal (NM) is produced on a conductor 344 if the velocity of the vehicle is determined to be less than a predetermined threshold level, e.g., two miles per hour. If the velocity of the vehicle is greater than the predetermined threshold level an $\overline{NM}$ or motion signal is produced on a conductor 346.

The velocity signal is also coupled into another motion detection circuit 348 which determines if the velocity of the vehicle is greater than a second predetermined threshold, which in the present illustrative system may be, for example, 5 miles per hour. In addition, the velocity signal is also coupled into a third threshold detector 350 which detector is set to determine whether the speed of the vehicle exceeds a third threshold level, which in this example has been set at 57 miles per hour. The second threshold detector 348 produces an output signal identified as a low motion signal, or LM signal, which is a logical 1 if the velocity of the vehicle is in excess of 5 miles per hour. The third threshold detector 350 produces a high motion, or HM signal, which is a logical 1 if the velocity of the vehicle exceeds the 57 miles per hour threshold. The threshold detector 342 may comprise a pair of circuits similar to those shown in the threshold detector 348 and 350. As shown, the threshold detectors 348 and 350 may each comprise voltage comparators with appropriate biasing networks selected to cause the comparators to switch output states when the input signal reaches an amplitude corresponding to the respective predetermined threshold levels. As such threshold level detectors are well known in the art, a detailed description of their construction will not be given.

The $\overline{NM}$ signal is connected to a first input terminal of an AND gate 352, a second input terminal of AND gate 352 being connected to receive the LM signal from the comparator 348. An output terminal of AND gate 352 is connected to a first input terminal of an OR gate 354. The second input terminal of OR gate 354 is connected to an output terminal of an AND gate 356. This latter AND gate has a first input terminal connected to receive the NM signal and a second input terminal connected to receive the $\overline{LM}$ signal. The $\overline{LM}$ signal is developed at an output terminal of an inverter 358 whose input terminal is connected to receive the LM signal. With this arrangement the logical AND gate 356 provides a logical 1 output signal whenever the velocity of the vehicle is less than the first threshold level established by the NM signal, i.e., 2 miles per hour in the present illustration. The AND gate 352 on the other hand provides a logical 1 output signal only when the $\overline{NM}$ signal and the LM signal are at logical 1 levels. Thus, AND gate 352 will produce a logical 1 level signal when the vehicle speed is greater than the first threshold level and also greater than the second threshold level established by the comparator circuit 348. The net result is to provide a logical 1 output signal to the OR gate 354 if the vehicle speed is less than the first threshold level, e.g., 2 miles per hour, or if the speed is greater than the second threshold level, e.g., 5 miles per hour. The purpose, of course, is to provide a narrow range, i.e., a speed between 2 and 5 miles per hour when a cushion stop will be implemented.

An output terminal of OR gate 354 is connected to a first input terminal of AND gate 360. A second input terminal of AND gate 360 is connected to an output terminal of AND gate 300. It will be recalled that the output signal generated by the AND gate 300 was a logical 1 whenever the system was in a position stop control mode. Accordingly, when in the position stop control mode the AND gate 360 will develop a logical 1 outut signal whenever the velocity of the vehicle is less than the first threshold level of 2 miles per hour or greater than the second threshold level of 5 miles per hour. An output terminal of AND gate 360 is connected to an input terminal of an inverter 362. The inverter serves to convert the logical 1 signal developed by AND gate 360 into a logical 0 signal which is applied to a gate terminal of the FET 322. The FET 322 is gated into conduction by the logical 0 signal.

During the time when the vehicle velocity is between the first and second threshold levels the FET 322 is non-conductive and a gate signal must be applied to the FET 334 in order to render it conductive. To this end, the $\overline{NM}$ signal is coupled from the conductor 346 to a first input terminal of an AND gate 364. A second input terminal of AND gate 364 is connected to an output terminal of the inverter 358. Because an AND gate produces a logical 1 signal only when both of its input terminals are at a logical 1 level, the AND gate 364 will produce a logical 1 signal only if the vehicle is in motion so that the $\overline{NM}$ signal is a logical 1 and if the vehicle speed is less than 5 miles per hour so that the $\overline{LM}$ signal is a logical 1. The output terminal of AND gate 364 is connected to a first input terminal of AND gate 366. A second input terminal of AND gate 366 is connected to the output terminal of AND gate 300 so that the AND gate 366 will only be active when the system is in a programmed stop control mode. An output terminal of AND gate 366 is connected to an inverter 368 which inverts the logical 1 signal developed by the AND gate 366 and couples it to the gate terminal of the FET 334. The arrangement thus described provides a deceleration rate reference which is at a first level when the velocity of the vehicle is less than 2 miles per hour or greater than 5 miles per hour and provides a second deceleration rate when the velocity of the vehicle is between 2 and 5 miles per hour.

As was described with reference to FIG. 2, the inventive control system includes a brake anticipation circuit which anticipates the entry of the vehicle onto the desired speed/distance profile during the position stop control mode and operates to smooth the transistion from a motoring into a braking mode. The brake anticipation circuit 84 of FIG. 2 is shown in FIG. 6 and includes the threshold detector 350 which detects when the velocity of the vehicle is exceeding a third threshold level. An output terminal of the threshold detector 350 is connected to a first input terminal of a logical AND gate 372. To make the AND gate active only when the system is in a PS1 program stop control mode, a second input terminal of the AND gate 372 is coupled to an output terminal of a logical AND gate 370. The logical AND gate 370 has first and second input terminals which are connected respectively to receive the PS1 and $\overline{PS2}$ signals described previously with respect to FIG. 4. The logical signal developed by the AND gate 370 will be a logical 1 if, and only if, the system is in a position stop mode such that the PS1 signal has been generated and the second signal device has not yet been detected. In the event the second signal device has been detected, it is desirable to inhibit the brake anticipation system and to assure that maximum braking is effected. The AND gate 372 has its output terminal connected to a first input terminal of an AND gate 374, a second input terminal of AND gate 374 being connected to the output terminal of AND gate 300. The AND gate 374 is active only when the system is in a program stop control mode as evidenced by a logical 1 signal being generated by the AND gate 300. Thus, a logical 1 output signal will be generated by the AND gate 374 if the system is in a program stop control mode and a second signal device has not been detected and the vehicle speed is greater than a third threshold level.

An output terminal of the logical AND gate 374 is connected to a first input terminal of a logical AND gate 376. A second input terminal of the AND gate 376 is connected to an output terminal of a level detector 378. The level detector 378 has an input terminal connected via a conductor 380 and a resistor 382 to the output terminal of amplifier 282. Thus, the input signal to the level detector 378 is the program stop error signal developed at the output terminal of the amplifier 282. So long as the program stop error signal is negative or, if positive, so long as its magnitude is less than that of the preset negative bias in the level detector 378, this detector will provide a logical 1 signal to the logical AND gate 376 causing it to be active. If the vehicle speed is also greater than the third threshold level and the system is in the program stop mode as previously described, the AND gate 376 will produce a logical 1 output signal. An output terminal of the AND gate 376 is connected via a conductor 384 to a gate terminal of a field effect transistor 386. The output terminal of AND gate 376 is also connected to an input terminal of an inverter 388 whose output terminal is connected to a gate terminal of another field effect transistor 390. The FET's 386 and 390 work in conjunction to control an amplifier 392. The amplifier 392 is so arranged as to provide a fixed level of error signal onto the output conductor 66 when the brake anticipation circuit is active. In this regard the field effect transistor 386 has a source terminal connected through a resistor 394 to a positive voltage source. The source terminal is protected by an inverse parallel pair of diodes 396 and 398 which are connected between the source terminal and the signal ground. The drain terminal of the FET 386 is connected to a drain terminal of the FET 390. A source terminal to FET 390 is connected through a resistor 400 to a negative voltage source V−. The source terminal of FET 390 is protected by an inverse parallel connected pair of diodes 402 and 404 connected between the source terminal and signal ground.

The amplifier 392 is connected in an operational amplifier mode with a feedback resistor 406 and feedback capacitor 408 connected between an output terminal and an inverting input terminal. The output terminal is located at the cathode junction of a diode 410. The anode terminal of the diode 410 is connected to an emitter terminal of a transistor 412 which is driven by having its gate terminal connected to an output terminal of the amplifier 392. The collector junction of the transistor 412 is connected to a positive voltage source V+. A bias resistor 414 connects the junction at the cathode terminal of diode 410 to a source of voltage V−. Diode 410 and resistor 414 comprise part of the analog OR circuit 64. The inverting and non-inverting input terminals of the amplifier 392 are connected together by an inverse parallel pair of diodes 416 and 418. The non-inverting input terminal is biased by a resistor 420 connected between that terminal and a signal ground. Connecting the amplifier feedback loop to include the emitter follower transistors such as 312 and the diode 316 permits stabilization of the circuit with variations in gain of the transistors or with variations in temperature which may change their characteristics.

When brake anticipation is called for, the logical AND gate 376 produces a logical 1 output signal which is coupled to the gate terminal of the FET 386. This signal biases the FET 386 off. At the same time the inversion of this signal provided by the inverter 386 will be a logical 0 applied to the gate terminal of the FET 390. The logical 0 signal will cause the FET 390 to go into conduction providing a negative current bias to the inverting input terminal of the amplifier 392. Due to the inversion in amplifier 392, the emitter follower 412 will be gated into conduction causing a positive current to be supplied on the conductor 66 therefore calling for a fixed magnitude of braking. If the system is not in the brake anticipation mode, the AND gate 376 will provide a logical 0 output signal which will gate on the FET 386 and gate off the FET 390 by virtue of the inversion of the signal through the inverter 388. This will result in a positive current being supplied to the inverting input terminal of amplifier 392 and a negative voltage being applied to the gate terminal of the emitter follower 412. Accordingly, the emitter terminal of the transistor 412 will be driven toward the voltage −V through the resistor 414. If conductor 66 is driven in a positive voltage direction by amplifier 306, then diode 410 becomes reverse biased. In effect, the most positive voltage developed by either the amplifier 306 or the amplifier 392 will be the controlling signal appearing on the conductor 66.

Figure 7:
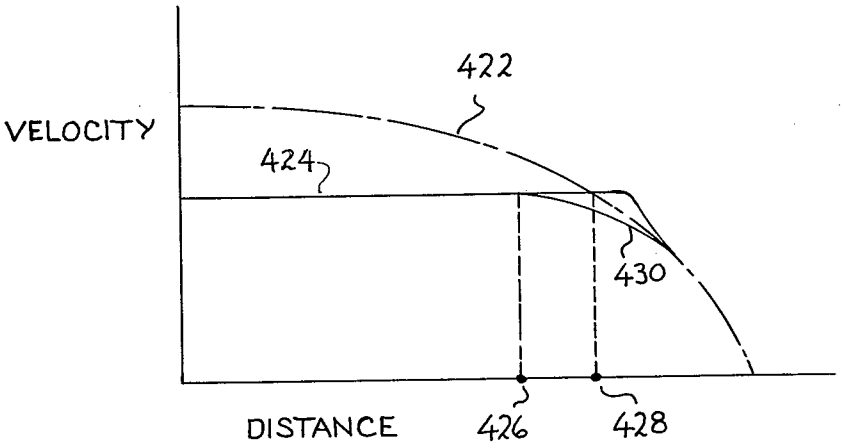
FIG. 7 is an illustration of the performance characteristics of a vehicle incorporating the present invention.

For a better understanding of the effect of the brake anticipation circuit, reference is made to FIG. 7 in which there is shown a desired velocity versus distance profile and an actual velocity versus distance curve for a vehicle. The line 422 represents the maximum velocities of a vehicle over a range of distances from the stopping point 423 for which the vehicle can be stopped without exceeding the desired deceleration rate. The line 424 shows the actual velocity of the vehicle over a portion of the track. The point indicated at 426 is the point at which the vehicle enters into the position stop control mode. Without the brake anticipation function the velocity would remain constant until the point 428 at which the vehicle velocity intersects the desired profile. Because of the slope of this profile and the tendency of the vehicle to overshoot the performance profile as illustrated, an excessive amount of brake or jerk may be felt by the passengers. By instituting a brake anticipation function at the point 426, the vehicle can be caused to gradually slow so that the function follows the line illustrated at 430 and gradually rounds into the desired profile. This anticipation function therefore provides a smooth transition onto the desired distance/velocity profile.

Although the present invention has been illustrated in a preferred form, it will be apparent that many modifications may be made by those skilled in the art without departing from the spirit of the invention. It is intended, therefore, that the scope of the invention be limited only by the appended claims.

What I claim as new and desire to secure by Letters Patent of the United States is:

1. In an automatic control system for a train of one or more wheeled vehicles traveling on a fixed guideway along which a plurality of wayside signal devices are located at different predetermined distances from a desired stopping point for providing information to the train indicative of the distance from a signal device to the desired stopping point, an improved arrangement for effecting operation of the train on a predetermined velocity-distance profile comprising:

(a) means for monitoring the rotational velocity of a selected wheel on a predetermined one of the vehicles and for producing a first signal representative of said rotational velocity;

(b) means for producing a second signal representative of the diameter of said selected wheel;

(c) means operative each time the train passes one of the wayside signal devices for generating a third signal that indicates the distance between the train position on the guideway and the desired stopping point;

(d) addressable memory means for storing a plurality of values respectively representative of the number of revolutions that a wheel of various different diameters would turn in order for the train to move the different predetermined distances on the guideway;

(e) logic control means responsive to said second and third signals for generating a memory address that causes said memory means to output the particular value stored at that address;

(f) counter means connected for receiving said memory output, said counter means being set to the value represented by said memory output each time the train passes one of the wayside signal devices;

(g) said counter means being responsive to said first signal for counting down from said set value in proportion to the actual revolutions of said selected wheel whereby the value remaining in said counter means is a continuous reference of the distance remaining to the desired stopping point;

(h) means responsive to said first and second signals for producing a velocity signal representative of the linear velocity of the train of vehicles;

(i) means for computing a value representative of the distance remaining to the desired stopping point as a function of the linear velocity of the train and a desired deceleration rate;

(j) means for comparing said computed distance value with said reference distance value and for producing an error signal representative of the difference therebetween; and (k) means responsive to said error signal for varying the actual velocity of the train in a manner to minimize said error signal and thereby stop said train at the desired stopping point.

2. The system of claim 1 and including means for producing a fourth signal representative of the number of vehicles in the train, said logic means being responsive to the combination of said second, third and fourth signals for generating said memory address.

3. The system as described in claims 1 or 2 wherein said error signal is summed with a signal representative of said desired deceleration rate to produce a deceleration command signal for controlling the tractive effort of the train of vehicles.

4. The system as defined in claim 3 and including:

(a) means for receiving a desired velocity command signal and for generating therefrom a velocity reference signal;

(b) summing means for combining said linear velocity signal and said velocity reference signal to thereby produce a velocity error signal; and (c) logic means connected for receiving said velocity error signal and said deceleration command signal and for selecting the most restrictive of said signals for controlling the velocity of the train of vehicles.

5. The system as described in claim 4 and including function generator means connected to said linear velocity signal producing means for developing a velocity correction signal as a non-linear function of said linear velocity signal, said velocity correction signal being summed with said velocity error signal to produce a modified velocity error signal to be applied to said last-mentioned logic means.

6. The system of claim 3 and including means for reducing the deceleration rate of the train by adjusting the magnitude of the desired deceleration rate signal when the linear velocity of the train is less than a first predetermined velocity and greater than a second predetermined velocity, said first and second predetermined velocities being within a low velocity range indicative of an impending stop.

7. The system of claim 1 and including brake anticipation means operative upon detection of said one wayside signal device for initiating a predetermined magnitude of braking effort of the train if said error signal is less than a predetermined value and said linear velocity signal exceeds a predetermined threshold.

8. The system of claim 7, and including means for inhibiting said brake anticipation means upon detection of a second wayside signal device.

* * * * *

UNITED STATES PATENT AND TRADEMARK OFFICE

CERTIFICATE OF CORRECTION

PATENT NO. : 4,302,811

DATED : November 24, 1981

INVENTOR(S) : Stuart W. McElhenny

It is certified that error appears in the above-identified patent and that said Letters Patent are hereby corrected as shown below:

Column 2, line 43, "powdered" should be corrected to -- powered --

Column 5, lines 20 to 21, delete "respective" and substitute -- representative --

Column 12, line 36, delete "Q" and substitute -- $\overline{Q}$ --

Column 14, line 18, delete "ANG" and substitute -- AND --

Column 14, line 56, insert"0" between "logical" and "signal"

Column 21, line 14, delete "to" and substitute -- of --

Signed and Sealed this

*Twenty-eighth* Day of *December 1982*

[SEAL]

*Attest:*

GERALD J. MOSSINGHOFF

*Attesting Officer*

*Commissioner of Patents and Trademarks*